US007921579B1

(12) United States Patent
French

(10) Patent No.: US 7,921,579 B1
(45) Date of Patent: Apr. 12, 2011

(54) APPARATUS AND METHOD FOR ADDING SECUREMENT MEANS TO A POINTE SHOE

(76) Inventor: Janet S. French, Louisville, KY (US)

( * ) Notice: Subject to any disclaimer, the term of this patent is extended or adjusted under 35 U.S.C. 154(b) by 540 days.

(21) Appl. No.: 12/142,250

(22) Filed: Jun. 19, 2008

Related U.S. Application Data

(60) Provisional application No. 60/946,022, filed on Jun. 25, 2007.

(51) Int. Cl.
*A43B 5/12* (2006.01)

(52) U.S. Cl. ..... 36/8.3; 36/113; 12/142 R

(58) Field of Classification Search ..... 36/8.3, 36/113, 58.5, 50.1; 12/142 R, 142 P
See application file for complete search history.

(56) References Cited

U.S. PATENT DOCUMENTS

| | | | | |
|---|---|---|---|---|
| 136,649 | A | 3/1873 | Goldthwait | |
| 442,798 | A | 12/1890 | Byrnes | |
| 2,026,004 | A | 12/1935 | Towse | |
| 2,110,890 | A * | 3/1938 | Paul | 36/8.3 |
| 2,683,316 | A * | 7/1954 | Reker et al. | 36/8.3 |
| 3,566,486 | A | 3/1971 | Conway | |
| 4,282,657 | A | 8/1981 | Antonious | |
| 5,257,969 | A * | 11/1993 | Mance | 36/8.3 |
| 5,946,827 | A | 9/1999 | Okajima | |
| 5,992,057 | A * | 11/1999 | Monti | 36/58.5 |
| 6,705,026 | B1 * | 3/2004 | Arbour | 36/8.3 |
| 6,895,694 | B2 * | 5/2005 | Nye | 36/8.3 |
| 7,225,563 | B2 | 6/2007 | Chen et al. | |
| 2007/0000149 | A1 * | 1/2007 | Juniman | 36/8.3 |

FOREIGN PATENT DOCUMENTS

| | | |
|---|---|---|
| FR | 2559655 | 8/1985 |

* cited by examiner

*Primary Examiner* — Ted Kavanaugh

(74) *Attorney, Agent, or Firm* — Theresa Fritz Camoriano; Camoriano and Associates

(57) ABSTRACT

An insert for a pointe shoe or other shoe provides a simple, efficient way to secure ribbons, elastic, and loops to the shoe.

16 Claims, 3 Drawing Sheets

APPARATUS AND METHOD FOR ADDING SECUREMENT MEANS TO A POINTE SHOE

This application claims priority from U.S. Provisional Application Ser. No. 60/946,022, filed Jun. 25, 2007, which is hereby incorporated herein by reference. The present invention relates to shoes, and, in particular to an apparatus and method that enables a person to add ribbons and other securement means to a shoe that has no securement means, such as a pointe shoe, in an efficient manner.

BACKGROUND

In traditional pointe shoes, a dancer buys the shoe and then, by hand, individually sews in ribbons or other securement mechanisms that are then used to secure the shoe to the dancer's foot. The dancer also may sew in an elastic that may be used to secure the shoe to the dancer's foot. This hand sewing requires skill and can be very time consuming. This creates a problem for the busy mothers of young dancers, who may not have the time or the skill to do the hand-sewing, and it creates a problem for professional dancers, who may wear out several pairs of shoes each week. If the ribbons and/or elastic are not installed securely, they may pull out of the shoe, preventing them from performing their intended function.

DESCRIPTION

Figure 1:
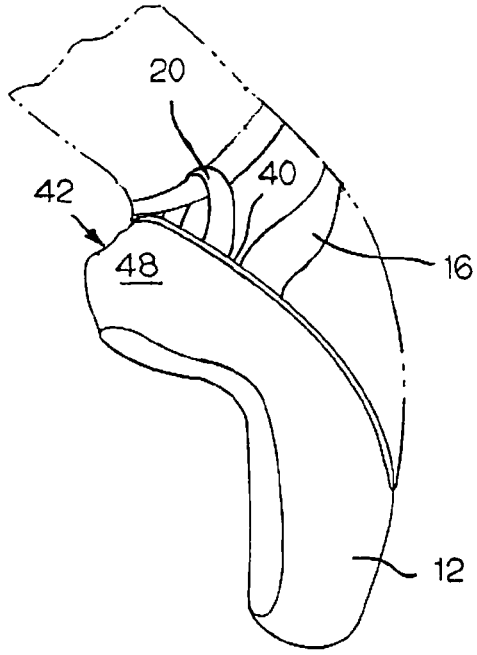
FIG. 1 is a perspective view of a pointe shoe with some securement mechanisms installed.
Figure 4:
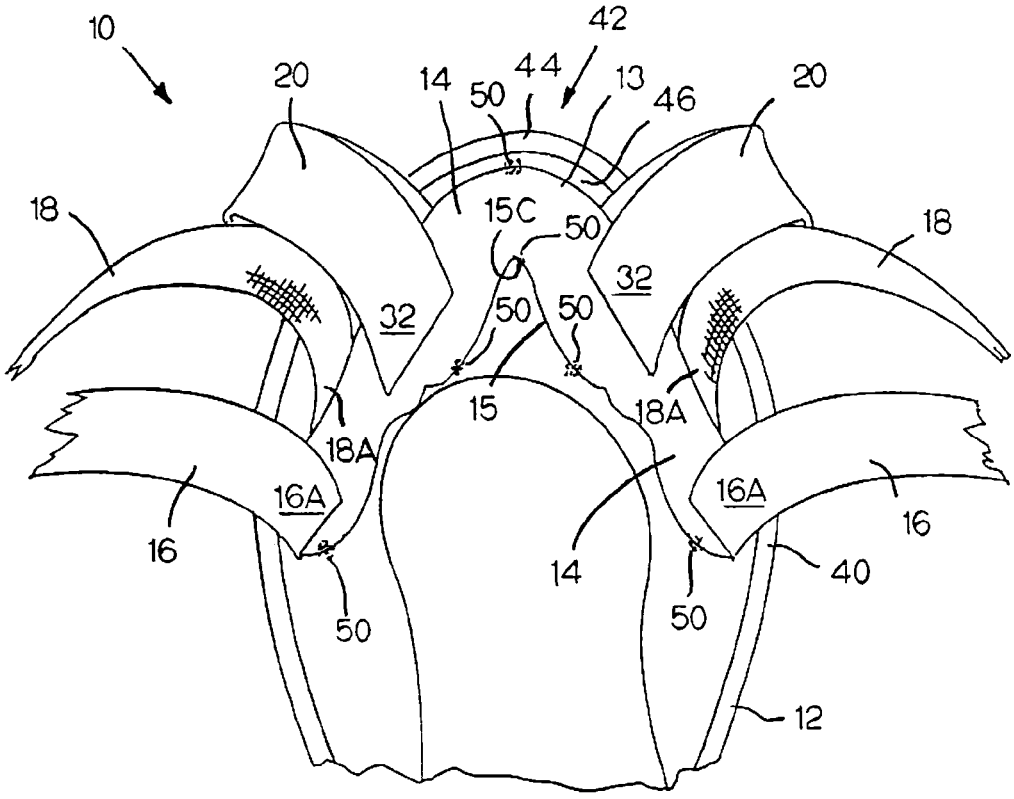
FIG. 4 is a top view of the rear portion of the shoe of FIG. 3 with the insert installed.
Figure 2:
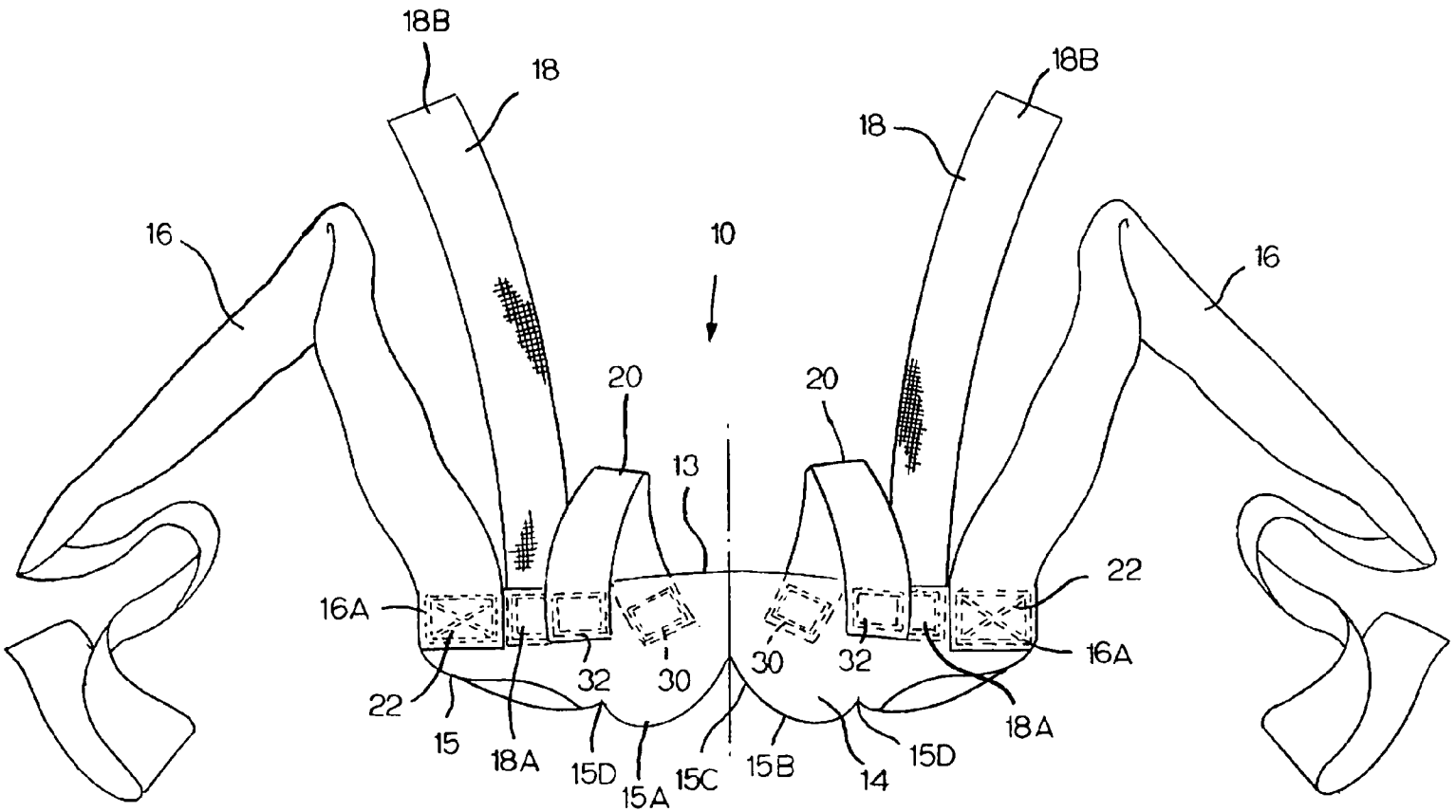
FIG. 2 is a front view of an insert that may be used to install the securement mechanisms of FIG. 1.
Figure 3:
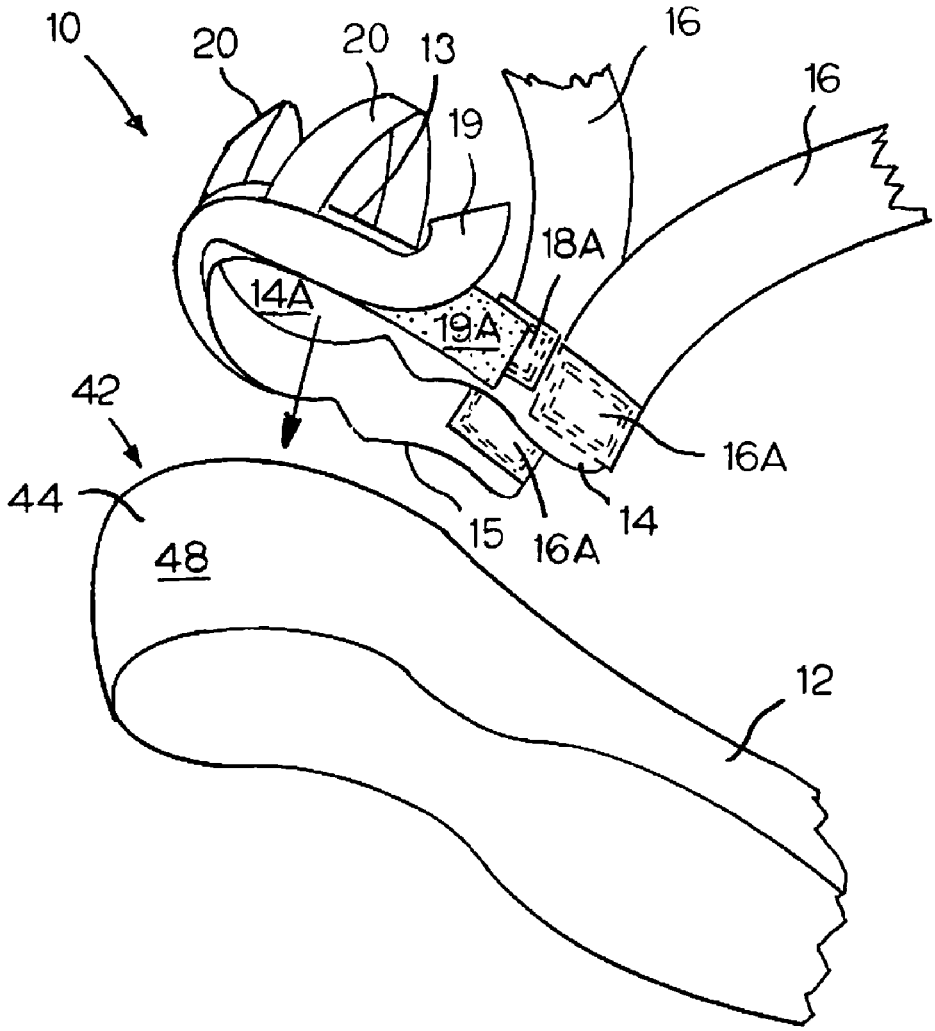
FIG. 3 is a broken-away exploded perspective view of the insert of FIG. 2 being installed in a pointe shoe.

FIG. 1 shows a pointe shoe 12 with some securement mechanisms installed, including a ribbon 16 and loops 20 which receive the ribbon 16. These securement mechanisms may be sewn into the shoe 12 individually by hand, or they may be installed by means of a prefabricated insert 10, as shown in FIGS. 2-4.

The insert 10 includes a heel liner 14, securement ribbons 16, elastic strips 18, and two loops 20. The heel liner 14 is made of a stretch knit fabric and is shaped in a manner that enables it to conform to the shape of the inner surface 46 of the heel portion 42 of the shoe 12. The top edge 13 of the heel liner 14 is essentially a straight horizontal edge, which aligns with the open top edge 40 of the heel portion 42 of the shoe 12. The bottom edge 15 of the heel liner 14 defines left and right arcuate lobe portions 15A, 15B, which form a central recess 15C, that is shaped like a large, inverted V. Each arcuate lobe portion 15A, 15B also has a smaller inverted V-shaped recess 15D at the midpoint of its lower edge. These inverted V-shaped recesses 15C, 15D, as well as the properties of the thin, knit material from which it is made, help the heel liner 14 curve to conform to the shape of the inner surface 46 of the heel portion 42.

The heel liner 14 is symmetrical about the central recess 15C, with the lobes 15A, 15B being mirror images of each other, and with each pair of left and right ribbons 16, left and right elastic strips 18, and left and right loops 20 being equidistant from the central recess 15C. It is expected that the prefabricated insert 10, as shown in FIGS. 2 and 4, will be sold in a kit, including two inserts 10, which the user will then install into the pointe shoes 12.

The heel portion 42 of the shoe 12 is made up of a rear wall 44 having an arcuate shape for extending around the rear of a foot. The rear wall 44 has an inner surface 46 and an outer surface 48. To install the heel liner 14 into the shoe 12, the central recess 15C of the heel liner 14 is aligned with the rearmost point of the arcuate rear wall 44.

There may be an adhesive on the back of the heel liner 14 for securing it to the shoe. The adhesive may be pre-installed as a layer 19A on the rear surface 14A of the heel liner 14 with a peel-off covering 19 protecting the adhesive layer until it is to be used, as shown in FIG. 3. (FIG. 3 shows the adhesive layer 19A being terminated before the ribbons 16 for clarity, but in actual use, the adhesive layer 19A preferably would extend to the left and right ends of the heel liner 14 in order to provide good securement for the entire heel liner 14.) Alternatively, an adhesive may be applied to the back of the heel liner or to the inside surface 46 of the heel 42 or both by the user as part of the installation process. If an adhesive is to be used, and if it is not provided as a pre-installed layer with a peel-off covering, then a tube or other container of adhesive (not shown) may be provided in the kit with a pair of inserts 10.

The heel liner 14 may be stitched into the shoe after adhering it by means of an adhesive, or, alternatively, the user may stitch the insert 10 into the shoe 12 without using an adhesive. The stitching may be done by hand or by machine.

FIG. 4 shows some key points 50 where the heel liner 14 preferably is spot sewn to the shoe 12 by hand to firmly secure the liner 14 to the shoe 12. Of course, the heel liner 14 may be stitched to the shoe 12 in many other places in addition to or instead of these key points 50.

When the heel liner 14 is installed in the shoe 12, it conforms to the shape of the rear wall 44 of the shoe 12, and the rear surface 14A of the heel liner 14 abuts the inner surface 46 of the rear wall 44 of the shoe 12 along substantially the entire rear surface 14A of the heel liner 14.

Prior to installing the heel liner 14 into the shoe 12, the left and right securement ribbons 16 are fixed at their bottom ends 16A adjacent to the left and right ends or the heel liner 14, respectively, by stitching at left and right ribbon positions 22, which are adjacent the left and right ends of the heel liner 14. In this particular embodiment, each ribbon 16 is folded back on itself before stitching it to the heel liner 14 in order to provide improved strength. The ribbons 16 then extend upwardly from the heel liner 14. When the heel liner 14 is installed in the shoe 12, the ribbons 16 extend upwardly from the open top edge 40 of the shoe 12, as shown in FIG. 4.

The left and right elastic strips 18 also are prestitched to the heel liner 14 at their bottom ends 18A prior to installing the heel liner 14 into the shoe 12. The elastics 18 are located between the ribbons 16. After the heel liner 14 is installed in the shoe 12, the user decides how much of the elastic to use and then cuts off the elastic to the desired length and may then stitch the other end 18B of the elastic 18 into the shoe 12 at the desired position, generally on the opposite side of the shoe. FIG. 3 shows only the bottom end 18A of the elastic strip 18, as the rest has been cut off in order to provide the securement arrangement shown in FIG. 1, in which the elastics 18 are not used.

In addition to the left and right elastic strips 18, there are left and right loops 20, which are located between the elastic strips 18. In this embodiment, the loops 20 are made of an elastic knit net material having a circular cross-section so that it is essentially a flattened tube. The ends 30, 32 of each loop 20 are offset from each other, with the end 30 on the rear side of the heel liner 14 and the end 32 on the front side of the heel liner 14 in order to limit the added thickness of the insert, and are stitched to the heel liner 14 prior to installing the heel liner 14 into the shoe. As with the other securement mechanisms (the ribbons 16 and the elastic strips 18), each end 30, 32 is stitched along more than one stitching line to ensure that it is secured to the heel liner 14 and does not pull free. In this embodiment, the securement mechanisms are machine stitched to the heel liner 14, ensuring a repeatable, secure connection for every insert 10.

Once the heel liner 14 has been installed in the shoe 12, the ribbons 16 may be crossed across the front of the wearer's foot and then inserted through the loops 20 to help secure the shoe to the wearer's foot, as shown in FIG. 1.

Of course, it would be possible to stitch the loops 20 or other securement means separately into the shoe in the same positions shown here but without using the heel liner 14. However, by fixing the securement mechanisms to the heel liner 14 prior to securing the heel liner 14 to the rear wall 44 of the shoe 12, it becomes much easier to ensure that the securement mechanisms are properly located and are securely fixed to the shoe 12.

When the heel liner 14 is secured to the rear wall 44 of the shoe 12, it causes the bottom ends of the securement ribbons 16, of the elastic strips 18, and of the loops 20 to be fixed to the rear wall 44, so that pulling upwardly at the top ends of the ribbons 16 or of the elastic strips 18, or pulling upwardly on the loops 20 pulls upwardly on the shoe 12 adjacent to the positions at which the securement mechanisms are fixed to the heel liner 14, essentially as if the bottom ends of those securement mechanisms had been sewn directly into the rear wall 44 of the shoe 12, thereby allowing the securement mechanisms to function normally to secure the shoe 12 to the wearer's foot.

The heel liner 14 preferably is a cream color to blend into the inside of the shoe 12. The ribbons 16, elastic 18, and loops 20 preferably are a natural pink or ballet pink to blend with the wearer's ballet tights. However, other colors may be used.

While it is envisioned that the inserts 10 will be sold in a kit in pairs and inserted by the purchaser into the shoes 12, it would also be possible to sell shoes with the inserts 10 already installed, so the buyer only has to cut the elastics 18 to length and stitch in the free ends of the elastics 18.

It also should be noted that the dancer may not want to use all the features of the insert, in which case any unwanted securement mechanisms may easily be cut off, as the elastics 18 have been cut off in FIG. 3. Alternatively, inserts may be provided that do not have as many securement mechanisms as shown here. While the heel liner 14 shown here is installed conforming to and abutting the inner surface 46 of the rear wall 44, it could alternatively be installed conforming to and abutting the outer surface 48.

It will be obvious to those skilled in the art that modifications may be made to the embodiments described herein without departing from the scope of the present invention as claimed.

What is claimed is:

1. A method for installing securement means in a pointe shoe having a heel portion including an arcuate rear wall adapted to extend around the heel of a foot and defining an open top edge and having inner and outer surfaces, comprising the steps of:

providing a heel liner having left and right ends, top and bottom edges, and front and rear surfaces;

providing left and right securement ribbons, each having top and bottom ends;

fixing the bottom ends of said left and right securement ribbons to said heel liner at left and right ribbon positions, respectively, with each securement ribbon extending upwardly from the heel liner; and then securing said heel liner to the rear wall, with the heel liner conforming to the shape of and abutting the rear wall, so as to fix the bottom ends of the securement ribbons to the rear wall, with the left and right securement ribbons extending upwardly from the open top edge of the shoe such that pulling upwardly at the top ends of the left and right securement ribbons pulls upwardly on the heel liner and on the shoe adjacent to the left and right ribbon positions.

2. A method for installing securement means in a pointe shoe as recited in claim 1, wherein the bottom edge of said heel liner defines a central recess; wherein said rear wall has a rearmost point; and wherein the step of securing the heel liner to the rear wall includes aligning the central recess of the heel liner with the rearmost point of said rear wall; conforming the heel liner to the shape of the rear wall; and securing the heel liner such that it abuts the inner surface of the rear wall.

3. A method for installing securement means in a pointe shoe as recited in claim 1, and further including the step of fixing at least one upwardly-projecting loop to the heel liner between the left and right securement ribbons before securing the heel liner to the rear wall of the shoe, such that, upon securing the heel liner to the shoe, the loop extends upwardly from the open top edge of the shoe and is fixed relative to the rear wall of the shoe.

4. A method for installing securement means in a pointe shoe as recited in claim 3, and further including the step of securing a bottom end of an elastic strip to said heel liner between the left and right securement ribbons before securing the heel liner to the rear wall of the shoe, such that, upon securing the heel liner to the shoe, the bottom end of the elastic strip is fixed relative to the rear wall of the shoe, and the elastic strip extends upwardly from the open top edge of the shoe.

5. A method for installing securement means in a pointe shoe as recited in claim 4, wherein the bottom edge of said heel liner defines a central recess; wherein said rear wall is arcuate and has a rearmost point; and wherein the step of securing the heel liner to the inner surface of the rear wall includes aligning the central recess of the heel liner with the rearmost point of said rear wall.

6. A method for installing securement means in a pointe shoe as recited in claim 1, wherein securing the heel liner to the rear wall includes peeling off a covering from the rear surface of the heel liner to reveal an adhesive layer and then adhering the heel liner to the rear wall by means of that adhesive layer.

7. A method for installing securement means in a pointe shoe as recited in claim 1, wherein securing the heel liner to the rear wall includes sewing the heel liner to the rear wall.

8. A method for installing securement means in a pointe shoe as recited in claim 7, wherein securing the heel liner to the rear wall includes adhering the heel liner to the inner surface of the rear wall before sewing the heel liner to the rear wall.

9. A method for installing securement means in a pointe shoe as recited in claim 8, wherein the bottom edge of said heel liner defines a central recess; wherein said rear wall has a rearmost point; and wherein the step of securing the heel liner to the rear wall includes aligning the central recess of the heel liner with the rearmost point of said rear wall.

10. A method for installing securement means in a pointe shoe having a heel portion including an arcuate rear wall having a top edge and defining a rearmost point, comprising the steps of:

providing a substantially flat heel liner having left and right ends and top and bottom edges, wherein the bottom edge of the heel liner defines a central recess, and the heel liner has left and right sides that are symmetrical to each other and that lie on opposite sides of the central recess;

providing left and right securement ribbons, each having top and bottom ends;

fixing the bottom ends of said left and right securement ribbons to said heel liner at left and right ribbon positions adjacent said left and right ends, respectively, with the remainder of each securement ribbon extending upwardly;

fixing left and right loops to the heel liner at loop positions between the left and right securement ribbons, said loops projecting upwardly from said heel liner; and fixing the bottom ends of left and right elastics to said heel liner at elastic positions between said left and right securement ribbons, with the top ends of said elastics projecting upwardly from said heel liner; and then conforming said heel liner to the shape of the inner surface of said rear wall and securing said heel liner to the rear wall in close abutting engagement with the inner surface of the rear wall, with the central recess of the heel liner aligned with the rearmost point of the shoe, said securement ribbons, loops, and elastics projecting upwardly out the top edge of the shoe.

11. A method for installing securement means in a pointe shoe as recited in claim 10, wherein the step of securing the heel liner to the inner surface of the rear wall secures the securement ribbons, loops, and elastics to the rear wall such that pulling upwardly on any of the securement ribbons, loops, or elastics also pulls upwardly on the heel liner and on the rear wall adjacent to the respective positions of the ribbons, loops and elastics.

12. A mechanism for installing securement means in a pointe shoe, comprising:

a substantially flat heel liner, having a top edge, a bottom edge, left and right ends, and front and rear surfaces, said bottom edge defining a central recess;

left and right securement ribbons having bottom ends fixed to the left and right ends of said heel liner, respectively, at positions equidistant from said central recess, said ribbons extending upwardly from said heel liner and terminating in free top ends;

left and right loops secured to said heel liner equidistant from said central recess and projecting upwardly from said heel liner; and left and right elastics having bottom ends secured to said heel liner between their respective loops and securement ribbons and extending upwardly from said heel liner and terminating in free top ends.

13. A mechanism for installing securement means in a pointe shoe as recited in claim 12, and further comprising an adhesive layer on said rear surface and a peel-off covering on the rear of said adhesive layer.

14. A mechanism for installing securement means in a pointe shoe as recited in claim 12, wherein the bottom edge of the heel liner defines left and right arcuate lobes which form the central recess, having the shape of an inverted "V".

15. A mechanism for installing securement means in a pointe shoe as recited in claim 13, wherein the bottom edge of the heel liner defines left and right arcuate lobes which form the central recess, having the shape of an inverted "V".

16. A mechanism for installing securement means in a pointe shoe as recited in claim 15, wherein each of the left and right arcuate lobes has a midpoint and defines a smaller inverted V-shaped recess in its bottom edge near the midpoint.

* * * * *